United States Patent [19]

Miller

[11] 3,954,346

[45] May 4, 1976

[54] SAFETY STRIP

[76] Inventor: George W. Miller, 247 Amherst St., East Orange, N.J. 07018

[22] Filed: Dec. 9, 1974

[21] Appl. No.: 530,533

[52] U.S. Cl. ..... 404/16
[51] Int. Cl.[2] ..... E01F 9/04
[58] Field of Search ..... 404/14, 12, 15, 16; 350/97

[56] References Cited

UNITED STATES PATENTS

| | | | |
|---|---|---|---|
| 1,986,591 | 1/1935 | Meyer | 404/14 |
| 2,153,392 | 4/1939 | Robertson | 404/16 |
| 2,267,995 | 12/1941 | Shuger | 404/14 |
| 3,096,694 | 7/1963 | Lynn | 404/15 |
| 3,179,009 | 4/1965 | Sheffield | 404/16 |
| 3,512,460 | 5/1970 | Surine | 404/14 |
| 3,879,148 | 4/1975 | Eigenmann | 404/14 X |

*Primary Examiner*—Nile C. Byers, Jr.
*Attorney, Agent, or Firm*—Carl Miller

[57] ABSTRACT

An improved marker for road and pavement, and which is easier to be seen in night-time; the marker comprising a strip of durable rubber material secured by rubber based cement to the road or pavement surface, and the upper side of the rubber strip having reflectors imbedded therin for reflecting light rays for easy visibility thereof.

2 Claims, 3 Drawing Figures

SAFETY STRIP

This invention relates generally to roadway and pavement markers such as are used to outline a lane, a curb or stopping line.

A principle object of the present invention is to provide a safety strip of improved type for use as a roadway or pavement marker and which when installed on a roadway, greatly aids a motorist at night to see a median strip so that he does not cross it into an opposing traffic lane, thus promoting safety on a highway.

Another object is to provide a safety strip which is especially easily visible on rainy night when a medium strip of conventional painted type is most difficult to see.

Yet another object is to provide a safety strip which would be particularly desirable to be utilized at cross walks.

Yet another object is to provide a safety strip which eliminates the periodic re-painting of painted medium strips in a center of a roadway.

Other objects are to provide a safety strip which is simple in design, inexpensive to manufacture, rugged in construction, easy to use and efficient in operation.

Further objects of the invention will appear as the description proceeds.

To the accomplishment of the above and related objects, my invention may be embodied in the form illustrated in the accompanying drawings, attention being called to the fact, however, that the drawings are illustrative only, and that changes may be made in the specific construction illustrated and described within the scope of the appended claims.

Figure 1:
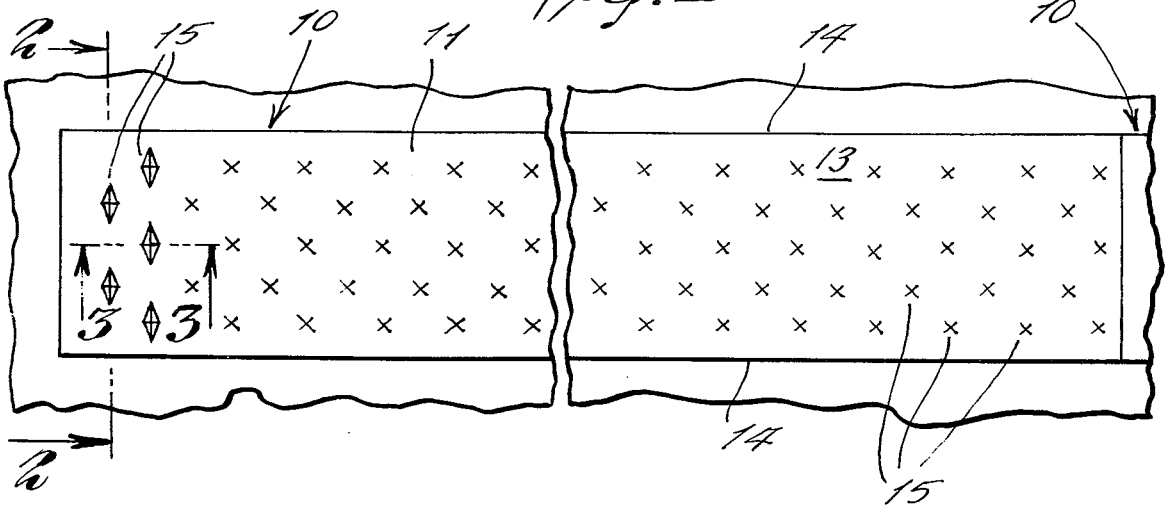
FIG. 1 is a plan view of the safety strip only a portion of the diamond shaped reflectors being shown.

Refering now to the drawing in detail, the reference numeral 10 represents a safety strip according to the present invention wherein there is an elongated strip of wear-resistant white rubber material 11 having a flat underside 12 and a cross sectionally upwardly bulged or rounded upper side or surface 13.

Figure 2:
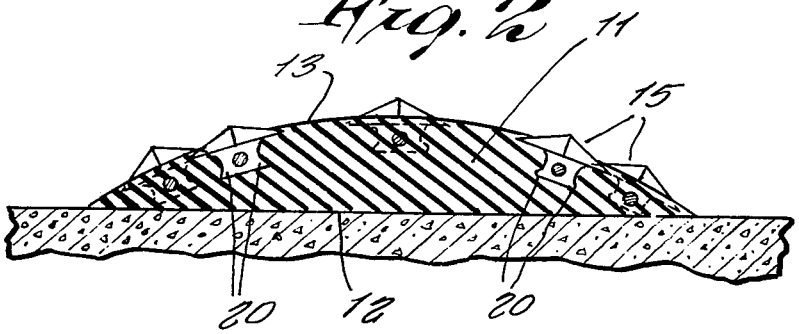
FIG. 2 is a cross-sectional view taken on line 2—2, FIG. 1 showing the safety strip adhesively secured to the pavement surface and the manner of anchoring and embedding the reflectors in the strip.

While the present invention is not limited to specific dimensions, the following sizes are only suggested for the manufacture of a practical size of safety strip. The strip can be made 5 inches wide and 3/4 of an inch thick vertically at its center. The side edges 14 are tapered to a thin blade as shown in FIG. 2.

Figure 3:
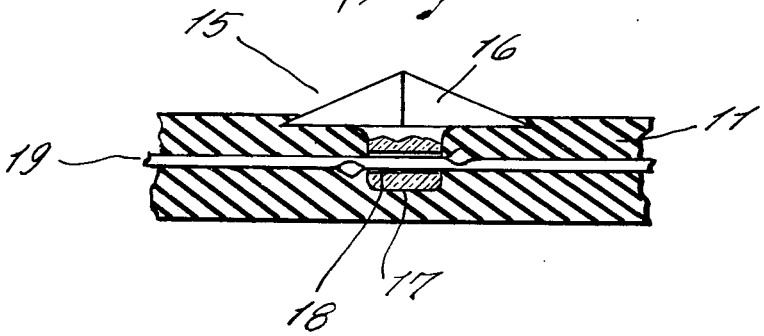
FIG. 3 is a detail sectional view taken on line 3—3 of FIG. 1, and showing the lower reflection portion imbedded it the strip, and the anchoring and spacing flesible wire and/or rod connected to the lower reflection portion.

A series of diamond shaped glass reflectors 15 are imbedded within the top surface 13 of the strip. Each reflector comprises a multi-faceted pyramidic head 16 entegral with a stem 17 having a transverse opening 18 so to be fitted on an anchoring flexible wire or rod 19 imbedded within the interior of the strip material 10. Each rod 19 extends along a longitudinal direction of the strip and the reflectors are thus anchored thereupon in spaced apart relation by means of flat protrusions being impressed in the rod adjacent the opposite sides of the stem so to prevent the reflector sliding along the rod prior to installation thereof in the strip, the protrusion adjacent one side of the stem being on a diametrically opposite side of the rod to the protrusion adjacent the opposite side of the stem, as clearly shown in FIG. 3. The lower end of each stem 17 is sidewardly flared as shown at 20 so to further secure the reflector in material 10.

Thus there is provided an improved safety strip, and as shown in FIG. 1, the safety strips may be laid end to end abutment so to form a continuing highway divider or median strip.

While certain novel features of my invention have been shown and described and are pointed out in the annexed claims, it will be understood that various omissions, substitutions, and changes in the forms and details of the device illustrated and in its operation can be made by those skilled in the art without departing from the spirit of the invention.

What I claim as new and desire to secure by Letters Patent is:

1. In a safety strip, the combination of a length of wear-resistant white rubber strip securable to a pavement or roadway by a rubber-based cement, and means for easily seeing said strip at night and particularly on rainy nights said strip having a cross-sectionally upwardly rounded upper surface, said means comprising a series of multi-faceted, diamond-shaped glass reflectors protruding upwardly from said upper surface of said strip, said reflectors being anchored in said strip by lengths of rods, each said reflector incorporating a downward extending stem, each stem having a transverse opening therethrough receiving said rod, and said rods extending along a longitudinal direction of said strip.

2. The combination as set forth in claim 1 wherein said reflectors are anchored on each said rod in spaced apart relation.

* * * * *